United States Patent [19]

Johannsen

[11] Patent Number: 4,628,640

[45] Date of Patent: Dec. 16, 1986

[54] BELT SANDER APPARATUS

[76] Inventor: Hans-Peter Johannsen, Am Mühlrain 3, D-3559 Battenberg, Fed. Rep. of Germany

[21] Appl. No.: 692,782

[22] Filed: Jan. 17, 1985

[30] Foreign Application Priority Data

Jan. 17, 1984 [DE] Fed. Rep. of Germany ..... 3401462

[51] Int. Cl.[4] ..... B24B 21/08

[52] U.S. Cl. ..... 51/141; 198/811

[58] Field of Search ..... 51/141, 135 R; 198/811

[56] References Cited

U.S. PATENT DOCUMENTS

| | | | |
|---|---|---|---|
| 1,949,700 | 3/1934 | Turcott | 51/141 |
| 2,761,256 | 9/1956 | O'Connor | 51/141 |
| 3,170,272 | 2/1965 | Burnham | 51/141 |
| 3,408,775 | 11/1968 | Rutt | 51/141 |
| 4,218,125 | 8/1980 | Silverberg | 198/811 |

FOREIGN PATENT DOCUMENTS

| | | | |
|---|---|---|---|
| 2023540 | 11/1971 | Fed. Rep. of Germany | 51/141 |

*Primary Examiner*—Harold D. Whitehead
*Attorney, Agent, or Firm*—Ralph R. Rath

[57] ABSTRACT

The invention relates to a wide belt sander for the treatment of surfaces of materials where the sanding belt 3 is provided on the sliding contact 6 pressing against the blank 1 with air discharge perforations 10 and 11 provided on the lower side of the sliding contact for the formation of a dynamic air cushion 18 between sliding contact 6 and sanding belt 3. A pair of shims are located on opposite sides of the sliding contact 6 and are aligned with the lateral edges of the sanding belt to provide sliding surfaces for the edges and a sealing edge for the air cushion.

10 Claims, 3 Drawing Figures

BELT SANDER APPARATUS

TECHNICAL FIELD

The invention relates to an apparatus for supporting the rotating sanding belt of a wide belt sander comprising a sliding contact arranged within the rotating sanding belt and transversely in its longitudinal extent to the direction of movement of the sanding belt, said contact being approachable against a blank, and being provided for the formation of an air cushion between the sliding contact and the sanding belt on its running surface facing the rear side of the sanding belt with a multiplicity of air discharge perforations which are connected with an air infeed installation.

BACKGROUND PRIOR ART

In the case of belt sanders, be they longitudinal or wide belt sanders for the treatment of wood surfaces, the demand exists in many cases to improve only the quality of the surface by a uniform minor sanding, yet convex spots resulting from superficial unevenness should not be sanded off more vigorously than in relation to these spots of greater depth, as thereby the danger exists that thin veneer would be sanded all the way through at the convex spots. Thus, in these cases, what is required is no sanding to a uniform dimension in order to make the surface absolutely planar, but what is required is a uniform sanding off at all spots for an improvement of the surface quality which is equal everywhere.

This demand cannot be met with a rigid sliding contact over which the sanding belt moves. Hence, diverse measures are applied to achieve an elastic approach of the sanding belt against the surface to be treated. In the case of wide belt sanders, for instance, a sliding contact covered by a sliding coating is used, whereby an air cushion is generated between the sliding coating and the body of the sliding contact so that the sliding coating can be pressed in the form of an elastic cushion against the sanding belt treating the surface. However, no satisfactory results are obtained with this measure because thereby even the strongest pressure of the sanding belt takes place against the convex spots of the surface to be treated.

It already is known from Swiss Patent No. 477,263 and German Display Copy No. 20 23 540 to use a sliding contact provided on the running surface facing the rear side of the sanding belt with freely terminating air discharge nozzles so that a dynamic and not a stationary enclosed air cushion forms between sliding contact and sanding belt, which under certain conditions has the effect of actually adjusting the sanding belt to unevennesses of the blank surface as far as a range of about 1 millimeter, so that the intended uniform surface treatment can be accomplished. As results from German Display Copy No. 20 23 540, the sanding effect is a function of the thickness of the free air cushion as it is forming, which in turn can be influenced by the supply air pressure. Surprisingly, at higher supply air pressure which forms a thicker air cushion, substantially more uniform sanding off is accomplished, while at lower air pressure and with a thinner air cushion a calibrated sanding can be achieved for a uniform dimension of thickness.

One problem with this type of procedure resides in the machining of the edges of a blank contacted by the sanding belt and/or from where it moves away. German Display Copy No. 20 23 540 contains proposals for the solution of this problem. Even when mastering the problem of machining the edges, the method described in said document is practically unuseable for longitudinal belt sanders because the amount of seeping air at the sides of the sanding belt along the edges of the sliding contact is so high that energy-wise the operation of devices of this design is uneconomical.

The method described in German Display Copy No. 20 23 540 has been applied in connection with a wide belt sander. Because thereby the sanding belt operates via the longitudinal edges of the sliding contact, the consumption of air is substantially lower in the application with wide belt sanders. Depending on the thickness of the air cushion, and precisely with uniform surface sanding as mentioned above, a thicker air cushion is needed; however, considerable losses of air occur at the end of the sliding contact. For reasons of the critical processing of the edges of a blank, however, so far these losses of air were tolerated because the opinion prevailed that commensurate with the teachings of the German Display Copy No. 20 23 540, here an additional discharge of air is required to avoid producing an excessive edge sanding. Aside from the high consumption of air, which still is undesirable when using the wide belt sander, this method produces satisfactory results.

SUMMARY OF THE INVENTION

The invention is based on the problem of reducing the air consumption in an apparatus of the initially-mentioned kind, while maintaining the demands to be met with regard to the machining quality, including the avoiding of sanding off at the edges of the blank, in order to render the operation of the apparatus more economical as far as energy consumption is concerned. According to the invention, this problem is solved in that the rolling surface of the sliding contact is provided in the marginal area of the rotating sanding belt opposite its central operating range with elevations substantially extending over the entire width of the sliding contact, the marginal areas of the sanding belt sliding over said elevations.

These elevations form at the lateral edges of the sanding belt, that is, proximal to the ends of the sliding contact, a sealing of the area produced by the exposed air cushion between sliding contact and sanding belt. In contrast to earlier assumption, it has been demonstrated that even with such a lateral sealing, the grinding or sanding quality can be maintained unchanged. Aside from the reduction of the air consumption to about one-half of the earlier amounts, even improvements result beyond this in the sanding treatment because with the presence of the lateral sealing means the sanding belt is cooled uniformly with the presence of the lateral sealing means over its entire width by way of the dynamic air cushion. The heating of the sanding belt, in fact, causes detrimental effects on the quality of the sanding. While without the lateral sealing means in the area of the lateral edges of the sanding belt, especially the air discharged and generated as a result of the larger quality of flow it generated in this location, an increased cooling effect, with the use of the lateral sealing means, the air discharged substantially uniformally along the longitudinal edges of the sliding contact over which the sanding belt is moving.

While in the wide belt sanders known from prior art where no dynamic air cushion is used between the sliding contact and the sanding belt, a sliding coating is absolutely indispensable on the sliding contact, in order to maintain the lifetime of the sanding belt within tolerable limits. Such a sliding coating could be dispensed within wide belt sanders with dynamic air cushion, and the sanding belt could be allowed to operate immediately via a metallic sliding contact because an immediately-sliding contacting between the sanding belt and the sliding contact occurred only in the rounded edge area of the sliding contact in a minor degree. As a matter of principle, according to the invention, it also is possible to still provide a sliding contact with a metal surface into which the lateral elevations are worked or to which these elevations are secured in the form of additional parts. A particularly preferred embodiment of the invention, however, consists of now also using in the claimed apparatus with dynamic air cushion a sliding coating on the sliding contact. Such sliding coatings are known and consist, for example, of a fabric coated with graphite. In this preferred embodiment, it is particularly appropriate to produce the lateral elevations by intermediate parts which are inserted between the body of the sliding contact and the sliding coating. In the illustrated embodiment, a constant transfer from the elevation to the working surface of the sliding contact results from the invention, which has a favorable effect on the lifetime of the sanding belt in its marginal areas.

The additional use of a tensioned-on sliding coating reduces, on the one hand, the friction of the sanding belt on the elevated area, but on the other hand, and surprisingly, despite these additional friction points, this leads to a reduction of the belt drive energy, which anyway already is relatively low with the use of a dynamic air cushion. Furthermore, improvements in the machined surface have been observed.

When using a sliding contact, it should be provided with air discharge apertures which line up with the air discharge perforations in the body of the sliding contact. The air discharge apertures in the sliding coating may thereby be slightly larger in diameter than the perforations in the body of the sliding contact. However, it should be avoided to only provide air discharge apertures in the sliding coating which are located in the air conduit slots provided in the body of the sliding contact. In that case, in fact, a pressure drop would be created between the body of the sliding contact and the sliding coating which would lead to a undesirable stationary air cushion between the body of the sliding contact and the sliding coating, and thus to an air-cushion-like buckling of the sliding coating, which is undesirable according to the introductory remarks. Neither is there any advantage of the sliding coating perhaps only at the edges of the sliding contact because that way additional starting edges are created for the sanding belt and the distance between sanding belt and the body of the sliding contact is enlarged in the working area; this would harm the automatic adjustment of a certain spacing of the air cushion.

It is possible to pull the sliding contact in an appropriate manner over the longitudinal edges of the sliding contact body and fasten it at its side.

Depending on the sanding conditions, it is possible to operate with a thickness of the dynamic air ranging between about 1 and 3 mm, the elevations at the terminal areas of the sliding contact should correspond with these dimensions in their thickness. Preferably, the elevations should have a thickness of about 2 mm. The extent of elevations in the longitudinal direction of the sliding contact should be such that a sufficiently large adherence surface results for the sanding belt in its edge area and that thereby also adequate air sealing is accomplished. Thereby, a certain running of the sanding edge during the operation must be taken into consideration. The longitudinal extent of the elevations may amount to between 4 and 10 cm, for example.

The elevations advantageously are beveled toward the operating range of the sliding contact, whereby it suffices to exedute this bevel approximately over a stretch of 1 cm. In addition, the corners facing the operating range of the sliding contact should be rounded at the lateral edges of the sliding contact and/or be so fashioned that they are adjusted to the movement of the sanding belt in as favorable a manner as possible, in order to prevent the wear of the sanding belt in this edge area.

The elevations are to be arranged outside the maximum operating width of the sanding machine. For a perfect marginal machining of the blanks while using the maximum machining width, it even is appropriate to provide on each side of the sanding belt at least another row of air discharge apertures outside the maximum operating width. The elevations then should only be provided subsequent to these additional apertures. In each case, at least two longitudinal rows of air discharge perforations should be provided, with the perforations being arranged in staggered relation to each other in the individual rows. Air discharge perforations with a diameter of approximately 0.5 mm proved to be expedient.

BRIEF DESCRIPTION OF THE DRAWINGS

Below, the invention is explained in greater detail with reference to the appended drawings. In them.

DETAILED DESCRIPTION

Figure 1:
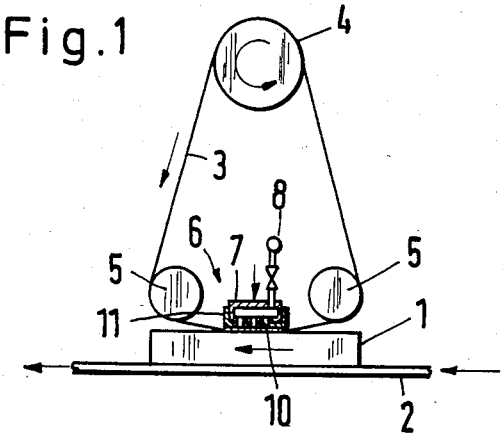
FIG. 1 shows, the schematic presentation of a wide belt sander in a lateral view with the blank feeding apparatus parallel with the drawing surface.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated.

FIG. 1 shows a blank or workpiece 1, for example a hard fiber plate provided with a wood veneer, said plate being borne by a grooved rubber conveyor belt 2 and being moved with it in the drawing surface to the left. An endless sanding belt 3 embracing a drive shaft 4 located on top and two lateral reversing rollers 5 located proximal to the blank operates over the veneered surface of the workpiece 1. A sliding contact 6 by which the sanding belt 3 can be pressed against the surface of the blank 1 is located within the sanding belt 3 between the reversing rollers. In order to have the sanding belt and the sliding contact approach the blank, appropriate installations are provided in the associated wide belt sander, which installations are known from prior art and therefore not represented in the schematic Figures of these drawings.

The sliding contact 6 consists of a sliding contact body 7 designed as a metallic hollow body and provided with an air connection 8 for introducing compressed air to its interior area. Air discharge nozzles 10 are provided in the bottom wall of the sliding contact body 7, terminating in its lower running surface 9, said nozzles having an approximate diameter of 0.5 mm. In the illustrated embodiment, the air discharge perforations are arranged in three longitudinal rows with the perforations being arranged staggered with respect to each other in the individual rows. At least two longitudinal rows of perforations ought to be provided.

A sliding coating 11 consisting, for example, of a fabric coated with graphite is tensioned over the running surface 9 of the sliding contact body 7. The sliding coating 11 contains air discharge holes 12 lined up with the air discharge perforations 10 of the sliding contact body; the former may be slightly larger than the latter.

Figure 2:
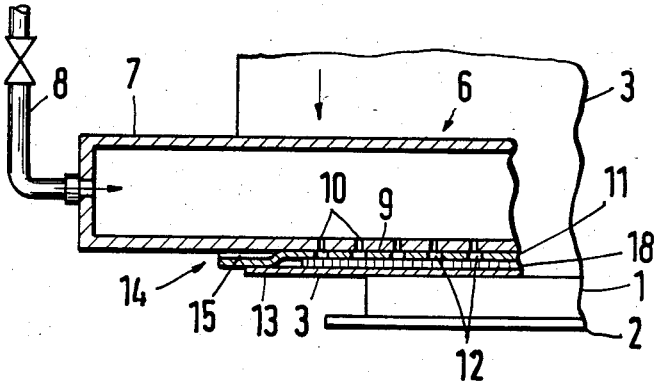
FIG. 2 shows a partial view upon such an arrangement in the direction of the blank feed; and, FIG. 3 shows a schematic three-dimensional representation of the terminal area of the sliding contact with an elevation for the lateral sealing of the sanding belt.
Figure 3:
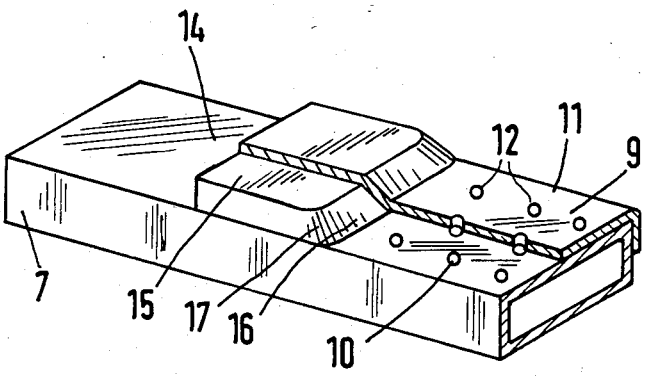

As can be seen from FIGS. 2 and 3, the sliding contact 6 shows in that area where it is embraced by the edge 13 of the sanding belt, an elevation 14 at its running surface 9. The elevation 14 is formed from a shim 15 secured to the sliding contact body 7, the sliding coating 11 being tensioned over said shim. In the embodiment, the shim consists of one or two layers of the material of the sliding coating and its height is about 2 mm. For the operation of the sanding belt, it is expedient for the shim 15 to have a certain elasticity.

As can be seen particularly from FIG. 3, the elevation 14 and/or the shim 15 is beveled at its transfer edge 16 pointing to the operating surface of the sliding contact. Moreover, the corners 17 of the shim and, insofar as necessary, also its other edges are rounded and/or shaped that they are adjusted more favorably to the moving configuration of the sanding belt. Such a constant adaptation also is improved in that the sliding coating 11 is tensioned via the shims 15 and thus itself forms part of the elevation 14. At the same time, it acts in this area in a friction-impeding manner on the sanding belt 3 which here is a sliding contact with the elevation 14.

During the operation of the wide belt sander, a dynamic air cushion with a thickness of about 1 to about 3 mm forms in the space 18 (see FIG. 2) between the sanding 3 and the sliding coating 11, depending on operating conditions, said cushion experiencing by virtue of the elevations 14 an effective lateral sealing without causing an detrimental effect on the sliding contact by the action of the dynamic air cushion; on the contrary, the sanding quality is further improved. The essential effect, however, is the reduction of the air consumption and thus of the energy requirement of the machine. Thus, for example, during experiments, while maintaining an identical air cushion thickness, the supply air pressure of about 2 to 2.9 bars could be reduced with use of the lateral sealing means to about 0.6 to 0.8 bars in the embodiment according to the invention.

I claim:

1. Apparatus for supporting a rotating endless sanding belt adapted to sand a workpiece in a central operating range spaced from lateral edges comprising a sliding contact supported adjacent and extending across said belt beyond said lateral edges and having air discharge perforations connected with a pressurized source for producing an air cushion between said sliding contact and said central operating range of said belt, the improvement of lateral sealing means on said sliding contact aligned with said lateral edges of said belt and extending the full extent of said sliding contact to provide lateral edge seals for said air cushion while producing uniform grinding pressure in said central operating range.

2. Apparatus as defined in claim 1, in which said sliding contact has a tensioned sliding coating between said sealing means.

3. Apparatus as defined in claim 2, in which said lateral sealing means includes spaced shims and said sliding coating extends across said shims.

4. Apparatus as defined in claim 3, in which said shims have a thickness corresponding to the thickness of said air cushion.

5. Apparatus for supporting a rotating endless sanding belt having a central operating range located between opposite lateral edges and moving in a longitudinal direction comprising an elongated hollow body extending transversely of the rotating sanding belt and defining a stationary sliding contact surface exposed to said belt with opposite ends of said hollow body located beyond said lateral edges, said contact surface having air discharge perforations with a pressurized source connected to said hollow body for producing an air cushion between said contact surface and said belt in the central operating range of said belt, the improvement of lateral sealing means extending from contact surface outside of the central operating range of said belt and aligned with said lateral edges of said belt and providing bands for sliding contact with said lateral edges of said belt to provide seals for said air cushion while accommodating flexing of said belt to conform to irregularities of a workpiece being sanded in said central operating range.

6. Apparatus as defined in claim 5, in which said lateral sealing means comprises shims extending between opposite edges of said hollow body and having a thickness approximately corresponding to the thickness of said air cushion.

7. Apparatus as defined in claim 6, in which said shims having a thickness of between about 1 mm and 3 mm.

8. Apparatus as defined in any one of claims 6 or 7, in which said shims have beveled inner edges providing a smooth transition between upper surfaces of said shims and said contact surface.

9. Apapratus as defined in any one of claims 6 or 7 in which said shims have rounded corners on opposite ends of inner edges of said shims.

10. Apparatus as defined in any one of claims 6 or 7, further including a flexible sliding coating extending across said contact surface and said shims.

* * * * *